United States Patent [19]

Kamata

[11] Patent Number: 4,607,598

[45] Date of Patent: Aug. 26, 1986

[54] SUCTION DEVICE FOR TWO-CYLINDER INTERNAL COMBUSTION ENGINE

[75] Inventor: Yoshikiyo Kamata, Hachioji, Japan

[73] Assignee: Kioritz Corporation, Tokyo, Japan

[21] Appl. No.: 680,916

[22] Filed: Dec. 12, 1984

[30] Foreign Application Priority Data

Dec. 15, 1983 [JP] Japan ..... 58-192197[U]

[51] Int. Cl.[4] ..... F02B 75/24

[52] U.S. Cl. ..... 123/56 BC; 123/65 P; 123/73 A

[58] Field of Search ..... 123/56 B, 56 BC, 73 R, 123/73 A, 73 E, 74 R, 74 AE, 65 B, 65 P, 51 B, 51 BC, 51 BD

[56] References Cited

U.S. PATENT DOCUMENTS

| | | | |
|---|---|---|---|
| 974,544 | 11/1910 | Akerman | 123/73 A |
| 1,336,232 | 4/1920 | Isliker | 123/73 A |
| 1,578,476 | 3/1926 | Slaght | 123/51 B |
| 2,247,299 | 2/1939 | Klavik | 123/56 BC |
| 4,178,685 | 12/1979 | Inaga | 30/381 |
| 4,194,470 | 3/1980 | Magner | 123/73 A |
| 4,373,474 | 2/1983 | Schindler et al. | 123/56 B |
| 4,474,145 | 10/1984 | Boyesen | 123/73 A |
| 4,475,487 | 10/1984 | Fukuoka et al. | 123/73 A |

FOREIGN PATENT DOCUMENTS

| | | | |
|---|---|---|---|
| 467513 | 6/1914 | France | 23/51 BD |
| 30644 | 9/1972 | Japan . | |
| 0176416 | 10/1983 | Japan | 123/73 PP |

*Primary Examiner*—Craig R. Feinberg
*Assistant Examiner*—David A. Okonsky
*Attorney, Agent, or Firm*—Browdy & Neimark

[57] ABSTRACT

A suction device suitable for use with a two-cylinder internal combustion engine including a second suction port formed at a wall of at least one of the pair of cylinders in a position in which it is opened and closed by a piston in the cylinder, and a second conduit allowing the second suction port to communicate with a carburetor therethrough.

2 Claims, 2 Drawing Figures

SUCTION DEVICE FOR TWO-CYLINDER INTERNAL COMBUSTION ENGINE

BACKGROUND OF THE INVENTION

(1) FIELD OF THE INVENTION

This invention relates to suction devices for a two-cylinder internal combustion engine, and more particularly it is concerned with a suction device suitable for use with a two-cycle, two-cylinder internal combustion engine of the crankcase precompression type having at least one reed valve which is used with a power-driven machine, such as a chain saw, a power-driven sprayer, etc.

(2) DESCRIPTION OF THE PRIOR ART

Engines used with power-driven machines should meet the requirements of being compact in size, light in weight and high in output power while being minimized in vibration. One type of engine which best meets these requirements is a two-cycle internal combustion engine of the crankcase precompression type having at least one reed valve which has two cylinders located horizontally in face-to-face relation. In this type of two-cylinder, two-cycle internal combustion engine, it has hitherto been necessary to provide the engine with one reed valve of a larger size or a plurality of reed valves arranged in side-by-side relation to allow a sufficiently large amount of air-fuel mixture to be drawn by suction into a crankcase when the displacement volume of the engine is large. When this step is taken, the suction device becomes large in size. Additionally, the effective volume of the crankcase increases, with a result that difficulties might be experienced in performing satisfactorily precompression of the air-fuel mixture in the crankcase.

SUMMARY OF THE INVENTION

(1) OBJECT OF THE INVENTION

This invention has been developed for the purpose of obviating the aforesaid disadvantages of the prior art. Accordingly, the invention has as its object the provision of a suction device for a small two-cylinder engine which is simple in construction and yet high in efficiency.

(2) STATEMENT OF THE INVENTION

According to the invention, there is provided, in a two-cylinder internal combustion engine comprising a pair of cylinders, a pair of pistons each mounted in one of the pair of cylinders for reciprocatory movement, a crankcase having a crankshaft connected to the two pistons, a crank chamber defined by the crankcase to perform precompression of air-fuel mixtures, and a first conduit connected to a first suction port formed in the crankcase to maintain the crank chamber in communication with a carburetor via a check valve, a suction device comprising a second suction port formed at a wall of at least one of the pair of cylinders, and a second conduit for maintaining the second suction port in communication with the carburetor.

The suction device of the construction described hereinabove according to the invention enables a sufficiently large amount of air-fuel mixture to be fed in an instant into the crank chamber by virtue of the presence of the second suction port in spite of the engine being small in size, thereby making it possible to perform precompression of the air-fuel mixture in the crank chamber with a high degree of efficiency to increase the output power of the engine by causing same to operate at high speed. The provision of the second suction port also contributes to stabilization of the operation of the engine at idling and increases the resistance of the engine to icing.

PREFERRED EMBODIMENT OF THE INVENTION

Figure 1:
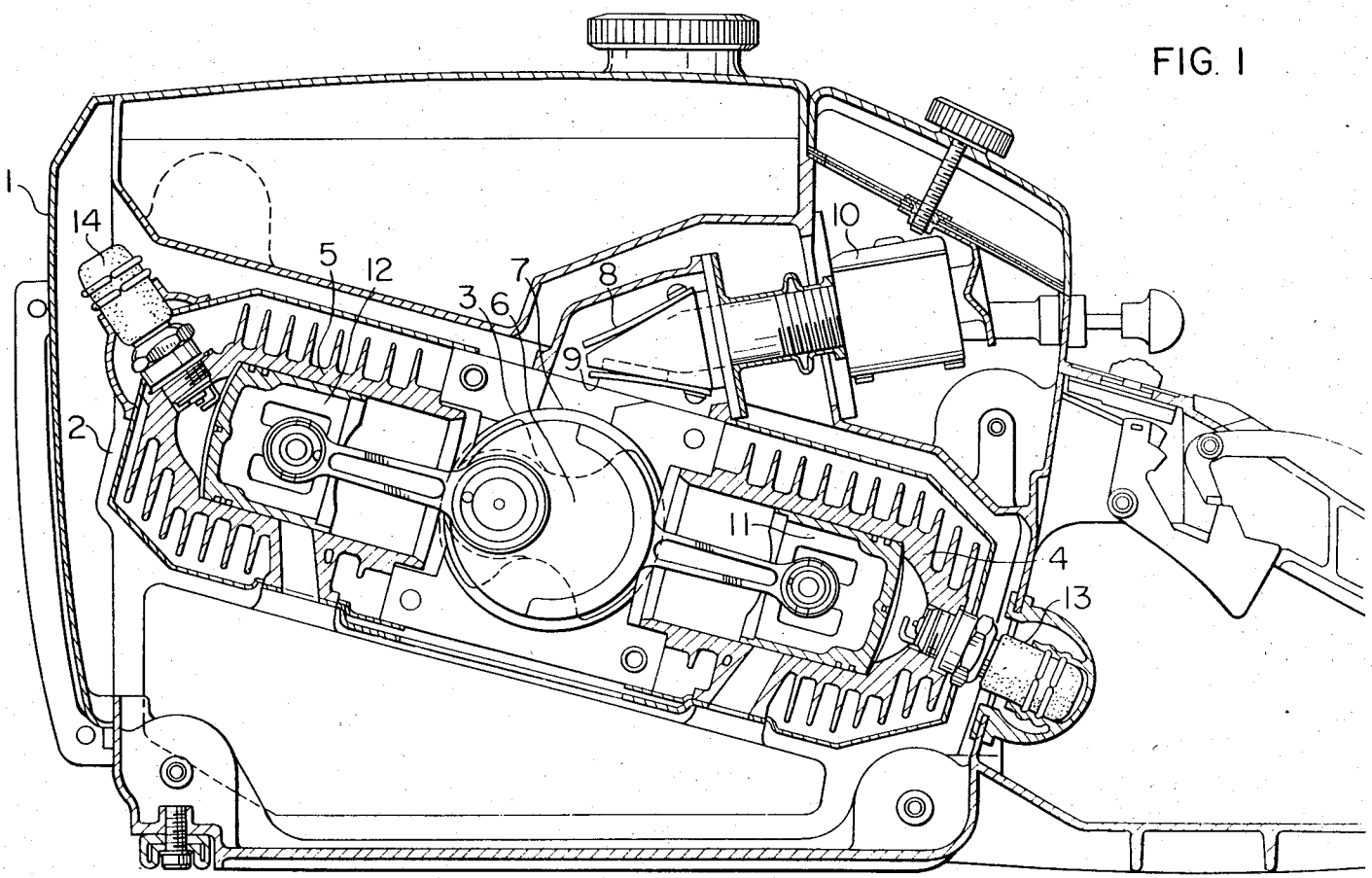
FIG. 1 PRIOR ART
FIG. 1 is a vertical sectional view of the essential portions of a portable chain saw having a two-cylinder internal combustion engine provided with a suction device of the prior art.

Before describing a preferred embodiment of the invention, an example of the suction device of the prior art will be outlined by referring to FIG. 1. FIG. 1 shows a chain saw of the portable type in which the present invention is incorporated. A main body 1 of the chain saw comprises a two-cylinder, two-cycle internal combustion engine 2 mounted therein. The engine 2 is of the type in which air-fuel mixture drawn into the two cylinders are simultaneously ignited and the air-fuel mixture are precompressed in the crank chamber. The engine 2 includes a crank case 3 located in the middle, and two cylinders 4 and 5 disposed horizontally on opposite sides of the crank case 3. The crank case 3 supports a crankshaft 6 having a phase difference of 180 degrees, and the cylinders 4 and 5 are offset with respect to the axis of the crankshaft 6 to enable ignition of the air-fuel mixture for the two cylinders 4 and 5 to be effected simultaneously. The crank case 3 is formed at its upper portion with a first suction port 7 which has a pair of reed valves 8 and 9 mounted therein to serve as check valves of the suction device. The suction port 7 is maintained in communication with a suction system 10 including a carburetor via the reed valves 8 and 9, so that the engine 2 functions as a type in which air-fuel mixture are drawn into the crank chamber and perform scavenging. In FIG. 1, the numerals 11 and 12 are pistons connected to the crankshaft 6 for reciprocatory movement in the cylinders 4 and 5 respectively. The numerals 13 and 14 designates electrical ignition plug mounted to the cylinders 4 and 5 respectively.

The preferred embodiment of the invention will now be described by referring to FIG. 2. The embodiment of the invention is incorporated in a two-cylinder internal combustion engine 22 of a chain saw of the portable type as is the case with the prior art shown in FIG. 1. The engine 22 which is of the type in which air-fuel mixture drawn into two cylinders are simultaneously ignited and the air-fuel mixtures are precompressed in the crank chamber is mounted in a main body 21 of the chain saw and includes a crankcase 23 located in the middle, and two cylinders 24 and 25 disposed horizontally on opposite sides of the crankcase 23. Ignition plugs 26 and 27 are mounted to the cylinders 24 and 25 respectively at heads thereof, and pistons 28 and 29 are mounted in the cylinders 24 and 25 respectively for reciprocatory movement and connected through connecting rods 31 and 32 respectively to a crankshaft 30 rotatably supported in the crankcase 23. The connecting rods 31 and 32 are pivotably connected to the crankshaft 30 in positions which are diametrically opposed to each other to allow the pistons 28 and 29 to move in reciprocatory movement with a phase difference of 180 degrees in the respective cylinders 24 and 25, to thereby enable simultaneous ignition to be effected. The cylinder 24, piston 28 and connecting rod 31 and the cylinder 25, piston 29 and connecting rod 31 constitute two different sets which are offset with respect to the axis of the crankshaft 30 in such a manner that they do not interfere with each other in operation. The crankcase 23 has an ordinary construction in which the crank chamber is split into two sections in the middle of the crankshaft 30 in a direction normal to the axis of the crankshaft 30.

A suction port 33 is formed at an upper wall of the crankcase 23 and has a reed valve 34 mounted therein which serves as a check valve preventing an outflow of air-fuel mixture therethrough from the crank chamber defined by the crankcase 23 to the suction port 33, although it allows the air-fuel mixture to flow therethrough from the suction port 33 to the crank chamber. The suction port 33 is connected at its upstream end to an outlet end of a carburetor 36 via a conduit 35 through which the air-fuel mixture is supplied from the carburetor 36 to the crank chamber via the suction port 33.

Figure 2:
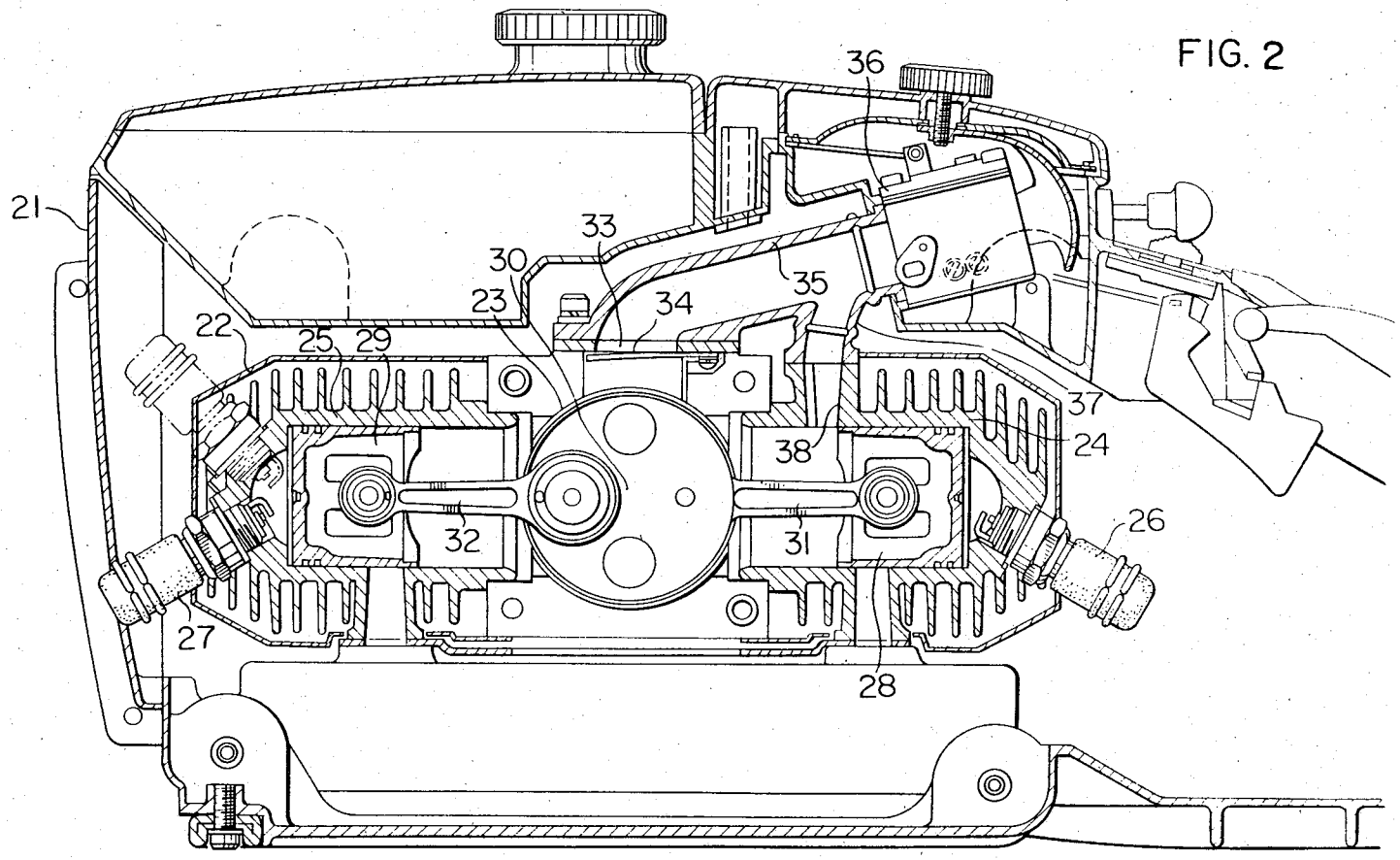
FIG. 2 is a vertical sectional view of the essential portions of a portable chain saw having a two-cylinder internal combustion engine provided with the suction device according to the invention.

The conduit 35 is formed integrally with another conduit 37 branching from a middle portion thereof and connected to another suction port 38 formed at a wall of the cylinder 24 and opening in a portion of the internal space of the cylinder 24 which communicates with the crank chamber when the piston 28 in the cylinder 24 is located at the top dead center or in the rightmost position shown in FIG. 2. More specifically, the suction port 38 is located in a position in which the suction port 38 is closed by the piston 28 as it moves from the top dead position to the bottom dead center or the leftward position shown in FIG. 2, and further leftward movement of the piston 28 seals and precompresses the air-fuel mixture in the aforesaid portion of the internal space of the cylinder 24 and the crank chamber. This allows a sufficiently large amount of air-fuel mixture to be introduced in an instant into the crank chamber via the suction ports 33 and 38 and enables precompression of the mixture to be performed efficiently.

Usually, one additional suction port formed in one cylinder of the part of cylinders 24 and 25 is enough to achieve the desired air-fuel mixture precompression effect. However, when necessary, it is possible to provide, in addition to the suction port 38 shown and described hereinabove, another suction port to the other cylinder of the pair within the scope of the invention.

What is claimed is:

1. In a two-cylinder internal combustion engine comprising a pair of cylinders, a pair of pistons each mounted in one of said pair of cylinders for reciprocatory movement, a crankcase having a crankshaft connected to the two pistons, a variable volume crank chamber defined by the crankcase and an area formed beneath each of said pistons so as to perform precompression of air-fuel mixture, and a first conduit connected to a first suction port formed in the crankcase to maintain the crank chamber in communication with a carburetor via a check valve; a suction device comprising:

a second suction port in direct communication with the crank chamber formed at a wall of at least one of sid pair of cylinders and being open and closed by said piston; and a second conduit allowing the second suction port to communicate with the carburetor therethrough.

2. In a two-cylinder internal combustion engine comprising a pair of cylinders, a pair of pistons each mounted in one of said pair of cylinders for reciprocatory movement, a crankcase having a crankshaft connected to the two pistons, a crank chamber defined by the crankcase to perform pre-compression of air-fuel mixture, and a first conduit connected to a first suction port formed in the crankcase to maintain the crank chamber in communication with a carburetor via a check valve; a suction device comprising:

a second suction port in direct communication with the crank chamber formed at a wall of at least one of said pair of cylinders uncovered by the piston when the piston is at top dead center;

and a second conduit connecting said second suction port to the carburetor upstream of the check valve and located to introduce air-fuel mixture into the crank chamber through both first and second suction ports with the piston at top dead center.

* * * * *